US007506412B2

(12) United States Patent
Schlichter

(10) Patent No.: US 7,506,412 B2
(45) Date of Patent: Mar. 24, 2009

(54) APPARATUS FOR A SLIVER-FORMING TEXTILE MACHINE, ESPECIALLY A DRAW FRAME, FLAT CARD OR THE LIKE

(75) Inventor: Stefan Schlichter, Viersen (DE)

(73) Assignee: Trützschler GmbH & Co. KG, Mönchenladbach (DE)

( * ) Notice: Subject to any disclaimer, the term of this patent is extended or adjusted under 35 U.S.C. 154(b) by 701 days.

(21) Appl. No.: 11/147,357

(22) Filed: Jun. 8, 2005

(65) Prior Publication Data

US 2005/0273980 A1 Dec. 15, 2005

(30) Foreign Application Priority Data

Jun. 11, 2004 (DE) ..... 10 2004 028 358

(51) Int. Cl.
*D01G 25/00* (2006.01)
*D01H 1/00* (2006.01)

(52) U.S. Cl. ..... 19/150; 19/296; 19/157

(58) Field of Classification Search ..... 19/150, 19/157, 296
See application file for complete search history.

(56) References Cited

U.S. PATENT DOCUMENTS 5,018,246 A * 5/1991 Leifeld ..... 19/150
5,343,598 A 9/1994 Hauner
5,704,096 A 1/1998 Lang
5,815,890 A * 10/1998 Leifeld ..... 19/288

FOREIGN PATENT DOCUMENTS

| | | | |
|---|---|---|---|
| DE | 39 13 548 | C2 | 10/1990 |
| DE | 44 38 883 | A1 | 5/1996 |
| DE | 198 23 571 | A1 | 3/1999 |
| GB | 2 144 159 | A | 2/1985 |
| GB | 2 231 343 | A | 11/1990 |
| GB | 2 277 106 | A | 10/1994 |
| GB | 2 294 953 | A | 5/1996 |
| GB | 2 306 221 | A | 4/1997 |
| GB | 2 336 855 | A | 11/1999 |

* cited by examiner

*Primary Examiner*—Shaun R Hurley
(74) *Attorney, Agent, or Firm*—Venable LLP; Robert Kinberg; Steven J. Schwarz

(57) ABSTRACT

In the case of an apparatus for a sliver-forming textile machine, especially a draw frame, flat card or the like, a fiber structure (fiber web) coming from the delivery rollers of a drafting system passes through a web guide and a sliver funnel with take-off rollers, the web guide has an inner wall (deflection and/or guide face), and a frictional resistance offered by the inner wall acts on the fiber structure. In order to allow in a simple manner an improved web guidance and sliver quality, and to permit the web guide to be adapted to different technical parameters, such as fiber material properties, working speed, a parameter relating to contact between fiber structure and inner wall is alterable.

29 Claims, 5 Drawing Sheets

APPARATUS FOR A SLIVER-FORMING TEXTILE MACHINE, ESPECIALLY A DRAW FRAME, FLAT CARD OR THE LIKE

CROSS REFERENCE TO RELATED APPLICATION

This application claims priority from German Patent Application No. 10 2004 028 358.3 dated 11 Jun. 2004, the entire disclosure of which is incorporated herein by reference.

BACKGROUND OF INVENTION

The invention relates to an apparatus for a sliver-forming textile machine, especially a draw frame, flat card or the like.

In certain sliver-forming textile machines a fibre structure (fibre web) coming from the delivery rollers of a drafting system passes through a web guide and a sliver funnel with take-off rollers, the web guide has an inner wall (deflection and/or guide face, and a frictional resistance offered by the inner wall acts on the fibre structure.

In the case of a draw frame, the fibre web, which consists of a plurality of drawn fibre slivers, is delivered at high speed from the delivery rollers of the drafting system and is introduced into the entrance opening of the web guide. The fibre web meets the inner wall of the approximately funnel-shaped fleece guide, is condensed and diverted towards the exit opening. The exit opening is arranged downstream of a sliver funnel, through which the fibre material is drawn off in the form of a fibre sliver by take-off rollers.

In the case of a known apparatus (DE 26 23 400 A), the web guide is provided on its side facing the drafting rollers with a sliding-contact face of concave form. The width of the sliding-contact face is greater than its height. The maximum depth of the sliding-contact face is selected so that it does not exceed 1.5 times the fibre length, measured from the nip of the feed roller. The structural form of the web guide is fixed, especially in operation. The path on which the fibres move from the drafting system through the web guide changes. The fibres of the fibre web along the lateral edges of the approximately triangular web guide and the adjacent fibres have to cover a greater distance than the fibres in the middle of the web, which leads to mutual displacement of the fibres, which adversely affects their parallel position and hence the uniform nature of the fibre fleece; it is even possible for tears to form at the edges thereof, with the result that the fibre sliver often becomes rough and wavy. In addition, it is inconvenient that it is impossible to adapt the web guide to different operating conditions and fibre material qualities.

It is an aim of the invention to produce an apparatus of the kind described initially, which avoids or mitigates the said disadvantages and which in particular in a simple manner enables the web guidance and sliver quality to be improved and allows the web guide to be adapted to different technical parameters, such as fibre material properties, working speed and the like.

SUMMARY OF THE INVENTION

The invention provides a web guiding assembly for use in a sliver-forming textile machine, comprising:

a web guide;

a sliver funnel; and a take-off mechanism for taking-off fibre from the sliver funnel;

wherein the web guide includes an inner wall with which the fibre material is, in use, in contact, and the web guide is arranged to permit adjustment of a parameter relating to said contact.

The features according to the invention take into account different kinetic and dynamic effects by and on the fibre fleece inside the web guide. The individually acting forces do not occur at all points to the same extent. Consequently, by changing a parameter relating to contact between the inner wall and the fibre material, for example, by changing the interaction and/or the spatial co-ordination between fibre web and inner wall, undesirable or disruptive forces can be partially and individually counteracted. In this way, a substantially improved web guidance and web quality is attained, and a very considerable increase in web running speed of above 1000 m/min can be successfully achieved, especially in the case of draw frames. The web guide improved in accordance with the invention enables the web quality to be enhanced accordingly also at web running speeds of below 1000 m/min, especially in the case of flat cards. The fibre sliver is substantially more uniform, notably in respect of the draft in its different sections or regions. The partial drafts and hence their effect on the sections and regions of the web in the web guide are more uniform and the tension draft as a whole is improved. The invention enables the same web guide to be adapted when there is a change-over, for example, when there is a change in the fibre material being processed, for example in the staple length. In addition, adaptation of the web guidance also in continuous production to changing technical parameters, for example, running speed, variations in thickness and the like, is advantageously rendered possible.

It is preferred for the interaction to be adjustable, for example, during operation and/or when the machine is not in operating mode. Advantageously, the interaction is automatically adjustable. Advantageously, the interaction is adjustable in a pre-determinable manner. Advantageously, the frictional resistance is at least partially reducible by altering the interaction and/or the spatial co-ordination between fibre structure and inner wall of the web guide. Advantageously, the frictional resistance is reducible at one or more regions of the inner wall. Advantageously, the frictional resistance is reducible segment-wise at the inner wall. Advantageously, the coefficient of friction p is alterable. Advantageously, the angle of resistance is alterable. Advantageously, the tension draft is alterable. Advantageously, the inner wall is formed at least partially from a low-friction material. Advantageously, the inner wall is coated at least partially with a low-friction material. Advantageously, the inner wall is at least partially of segment-like construction. Advantageously, the size and/or the position of the inlet opening of the web guide is alterable. Advantageously, forces acting on the fibre structure are the same as or greater than the pressure applied by the fibre structure to the inner wall. Advantageously, the frictional resistance at the points of greatest pressure application or frictional resistance of the fibre structure against the inner wall is reducible. Advantageously, the inner wall has a covering, for example, a coating, foil or the like, which has an alterable coefficient of friction in the conveying direction. Advantageously, the web guide has an inner wall surface that is spatially formed in such a way that on this surface all fibres of the fibre web have to cover an approximately equal path until they are combined to form the fibre sliver. Advantageously, the set angle of the lateral surfaces is alterable. Advantageously, the contour of the lateral surfaces is alterable. Advantageously, the inner wall surfaces are of resilient construction. Advantageously, the inner wall surface is at least partially alterable between concave, planar and convex.

Advantageously, mobile contour elements are associated with the inner wall surface. Advantageously, the contour elements are displaceable. Advantageously, the resistance to wear of the inner wall is alterable. Advantageously, the tension draft of the fibre structure is alterable, for example, by drive control. Advantageously, a measuring and observing device for the fibre web, for example, an electronic camera, video camera or the like, is associated with the web guide. Advantageously, the inner wall comprises at least lateral inner wall surfaces. Advantageously, the inner wall includes the top surface (upper web guide hinged cover). Advantageously, the inner wall includes the bottom surface (lower web guide hinged cover).

The invention also provides an apparatus for a sliver-forming textile machine, especially a draw frame, flat card or the like, in which a fibre structure (fibre web) coming from the delivery rollers of a drafting system passes through a web guide and a sliver funnel with take-off rollers, the web guide has an inner wall (deflection and/or guide face), and a frictional resistance offered by the inner wall acts on the fibre structure, characterised in that the interaction and/or the spatial co-ordination between fibre structure and inner wall of the web guide is alterable.

DETAILED DESCRIPTION OF PREFERRED EMBODIMENTS

Figure 1:
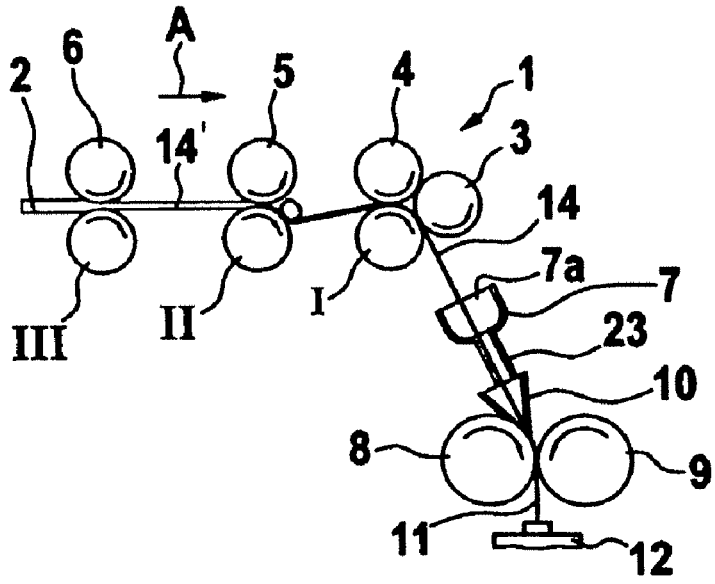
FIG. 1 is a diagrammatic side view a drafting system with an entrance opening of the web guide according to the invention, the web guide being downstream of the delivery rollers of the drafting system, and with a sliver funnel and take-off rollers.

Referring to FIG. 1, a draw frame, for example, a draw frame TD 03 made by Trützschler GmbH & Co. KG, comprises a drafting system 1 with a drafting system inlet and a drafting system outlet. The fibre slivers 2, coming from cans, enter a sliver guide and, drawn by take-off rollers, are transported past a measuring element 28 (cf. FIG. 4). The drafting system is designed as a 3-over-4 drafting system, that is, it consists of three bottom rollers I, II, III (I being the bottom delivery roller, II being the middle feed roller and III being the bottom feed roller) and four top rollers 3, 4, 5, 6. Drafting of the fibre sliver 2 comprising several fibre slivers takes place in the drafting system 1. The draft is made up of the preliminary draft and the main draft. The roller pairs 6/III and 5/II form the preliminary draft zone and the roller pairs 5/II and 3, 4/I form the main draft zone. The drawn fibre slivers (fibre web 14) reach a web guide 7 at the drafting system outlet and are drawn by means of the take-off rollers 8,9 through a sliver funnel 10, in which they are condensed to a fibre sliver 11, which is subsequently laid by way of a can coiler 12 in cans (not illustrated). The letter A denotes the running direction in the drafting system 1 of the fibre structure 14' comprising several fibre slivers.

Figure 2:
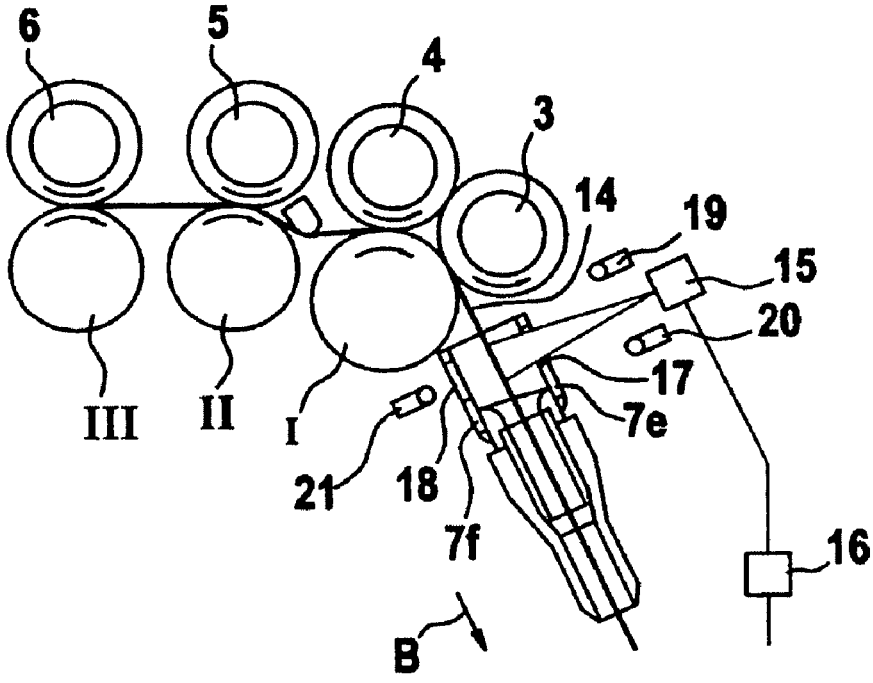
FIG. 2 is a diagrammatic side view of a drafting system similar to that in FIG. 1, with an electronic camera associated with the web guide.

In the embodiment of FIG. 2, in the top surface 7*e* (see FIG. 3*b*) and in the bottom surface 7*f* of the web guide 7 there is a transparent window 17 and 18 respectively. Externally at a distance from the top surface 7*e*, a CCD camera 15 and two light-emitting diodes (LED) 19, 20 are arranged opposite the window 17. Externally at a distance from the bottom surface 7*f*, a light-emitting diode (LED) 21 is arranged opposite the window 18. In this way, the fibre web 14 that has entered the interior 7*i* of the web guide 7 is optically detected between entrance opening 7*a* and exit opening 7*b*. The optical axis of the camera 15 lies perpendicular to the running direction B of the fibre web 14. The top and bottom surfaces 7*e*, 7*f* respectively are hinged; recordings are taken through the windows 17 and 18 with the top and bottom surfaces 7*e*, 7*f* closed. Because light-emitting diodes 19, 20 are located on the side with the camera 15 and a light-emitting diode 21 is located on the side of the web guide 7 remote from the camera 15, recordings of reflected light and transmitted light are possible. The recordings are effected both at delivery speed (900 in/mm and above) and also when accelerating and decelerating the speed of the fibre web 14. A CCD camera (charge coupled device camera) is present as electronic camera 15, which communicates with an electronic evaluation circuit 16 (image-processing unit) that is connected to an electronic control and regulating device 38 (see FIG. 4).

Figure 3A:
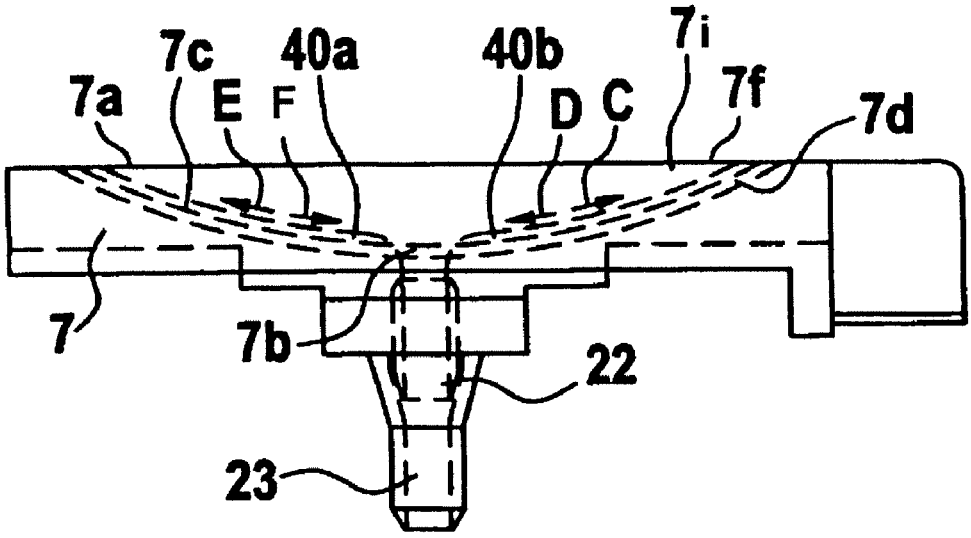
FIGS. 3*a*, 3*b* are a plan view in section and a front view, respectively, of the web guide of FIGS. 1 and 2.
Figure 3B:
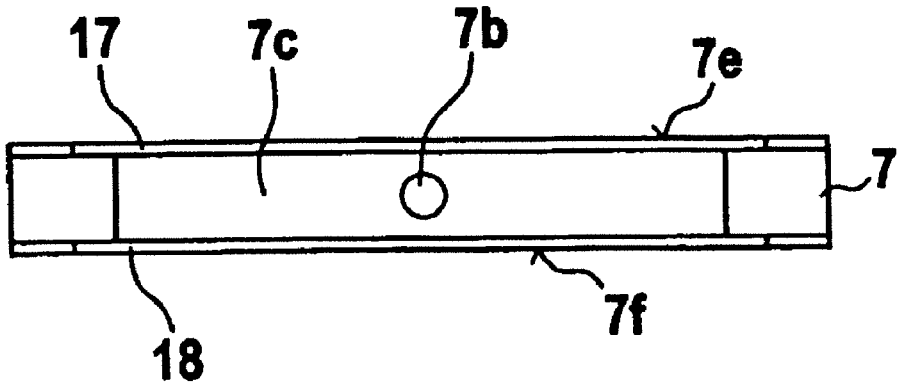

As shown in FIG. 3*a*, the web guide 7 is of funnel-like form and has an open side 7*a* (entrance-side opening) and a through-opening 7*b*. The interior 7*i* of the web guide 7 is formed by two concavely converging lateral surfaces 7*c*, 7*d*, and a respective planar top surface 7*e* and bottom surface 7*f* (cf. FIG. 3*b*). The top surface 7*e* and the bottom surface 7*f* are hinged. The entrance-side opening 7*a* is larger than the through-opening 7*b*. Adjoining the through-opening 7*b* are transfer tubes 22 and 23, which guide the condensed fibre web 14 into the web funnel 10 (see FIGS. 1 and 4). On the lateral inner wall surfaces 7*c* and 7*d* there is arranged an exchangeable coating 40*a* and 40*b* respectively, each of which has varying coefficients of friction in the respective running directions C and D.

In operation, the fibre web 14 leaving the roller pair 3/I passes through the entrance opening 7*a* into the interior 7*i* meets the coated inner surfaces 7*c* and 7*d*, is caused to converge by the coated inner surfaces and directed in the direction of arrows C and D to the exit opening 7*b*. As this happens, the fibre web 14 is condensed, air being expelled and escaping in the direction of arrows E and F opposite to the running direction B through the entrance opening 7*a* to the atmosphere.

Figure 4:
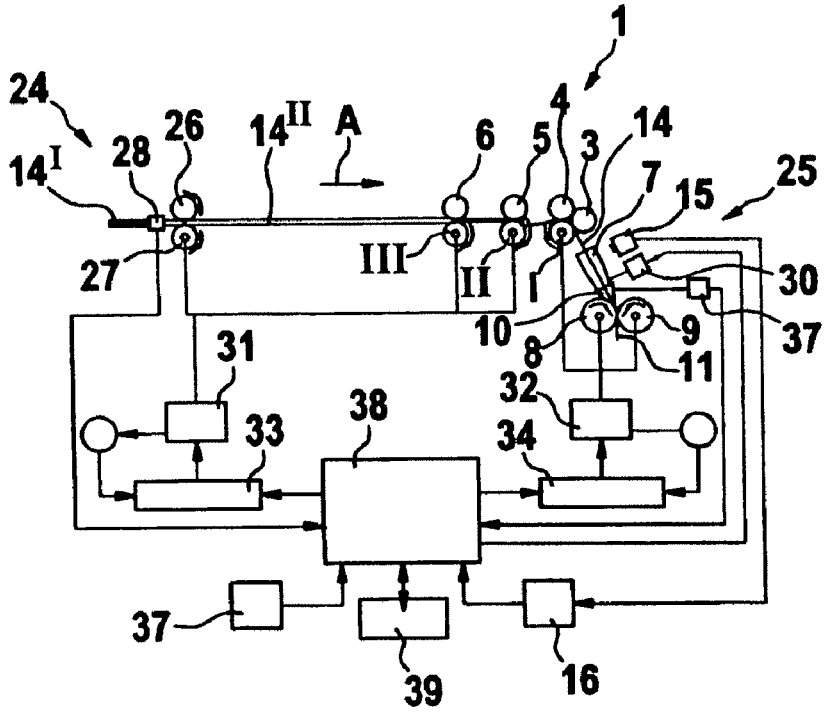
FIG. 4 is a diagrammatic side view of a drafting system with a block diagram of an electronic control and regulating device and comprising an apparatus according to the invention.

In the embodiment of FIG. 4, at the drafting system outlet 25 the drawn fibre slivers reach the web guide 7 and are drawn by means of the take-off rollers 8, 9 through the sliver funnel 10 in which they are condensed to the fibre sliver 11, which is subsequently deposited in cans. A central processing unit 38 (control and regulating device), e.g. a microcomputer and microprocessor, delivers a setting of the desired variable for an actuating element 30, which changes the inner wall surfaces 7*c* and 7*d*. The control value for the actuating element 30 is determined in the central processing unit 38 from the measurements of the camera 15 and/or from the desired value for the cross-section of the emerging fibre sliver 11.

The camera 15 is connected by way of the image-processing device 16 to the electronic control and regulating device 38. In this way, the results of the image analysis can be used in a closed loop system to optimise the web guide 7. The results of the image analysis of the fibre web 14 can be filed in a memory 39.

According to the exemplary embodiment, the CCD camera 15 can be used to take images of the web 14. Images of the web 14 can also be taken by means of digitised photodiodes. Evaluation of the digital image information is effected online by means of image analysis software. The camera axis lies preferably perpendicular to the web 14. The camera 15 can be moved along the inside frame width (IW) of the machine, in order to record images across the working width of the draw frame. Advantageously, the camera 15 can be moved automatically away from the web 14 or a wide-angle setting can be used on the camera in order to record the entire web width at one time. The camera 15 can also be pivotable, in order to record images across the working width of the draw frame. The web guide hinged members 7*e*, 7*f* are transparent, so that recordings of the web 14 are produced with the web guide 7 closed. The recordings are made of reflected light and transmitted light. For that purpose, LEDs are located on the camera side and on the draw frame side respectively. It is possible to record images of the web at delivery speed and when accelerating and decelerating. Advantageously, recordings are made in the middle region of the web in order to examine the web for uneven patches. The cause for this can include: poor short fibre guidance, poor gripping of the web, wrong drafting system settings. Furthermore, recordings of this web area can be used to analyse the degree of parallelization of the fibres, the number and size of neps, the structure influence of the material and dust formation that occurs. Using all these influences, the quality of the drafting process can be determined. Preferably, recordings are also made specifically of the edge region, in order to be able to analyse the guidance of the edge fibres in the drafting process (closed or incomplete web structure at the edges). It is thus possible, when removing the web, to determine whether there will be striations (along the fibres) across the working width. These occur because the slivers do not enter the web guide properly, that is, slivers enter one on top of the other or with too much distance between each other. By analysing the entire web width, an assessment of the tension draft in this region can also be made. A further advantage is that the alignment of the slivers or fibres is analysed. The number and the position of the obliquely-running or straight-running slivers is a measure of the effective tension draft. The take-off roller tension draft is dependent on the parameters: delivery speed, draft, friction, number of slivers, material, contamination etc.). Thus the real take-off roller tension draft is objectively determined. At the control and regulation device 38, images relating to fibre orientation at optimum tension draft can be stored. In particular, by means of a closed loop system the take-off roller tension draft can be fully automatically or semi-automatically (manual gear changing) specifically optimised.

The control and regulating device is connected via drive control 33 to drive motor 31 for the rollers 27, III and II and via drive control 34 to drive motor 32 for the rollers I, 8 and 9. Reference numeral 37 represents a processing device for processing signals from a sensing device (not shown) in funnel 10.

All available line scan sensors, such as LED line scan cameras 15, X-ray and infrared line cameras can be installed.

The invention was explained with reference to the example of an autoleveller draw frame. A non-regulated draw frame is also covered.

Figure 5:
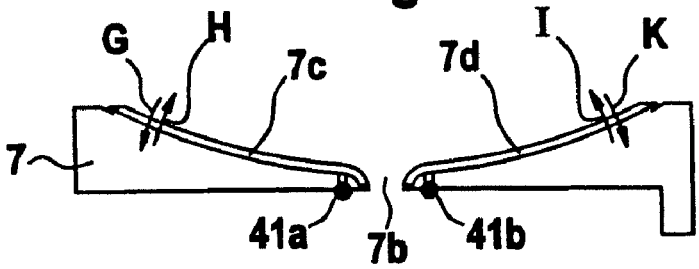
FIG. 5 is a schematic view of the interior of a web guide including pivotable lateral walls.

In FIG. 5 is shown one form of web guide 7 for use in an apparatus of the invention. In the region of the exit 7*b* each of the lateral walls 7*c* and 7*d* is associated with a swivel joint 41*a*, 41*b* respectively, so that the lateral walls 7*c*, 7*d* are pivotable in the direction of the arrows G, H and I, K respectively.

Figure 6:
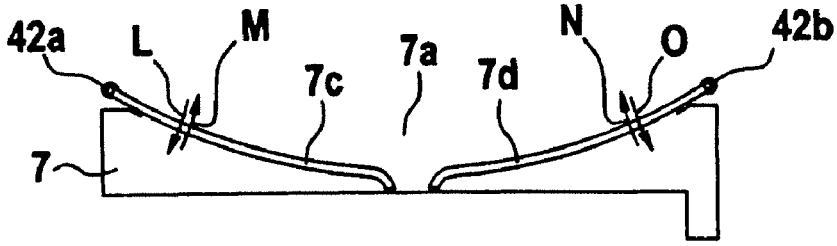
FIG. 6 is a schematic view of the interior of a second form of web guide having pivotable lateral walls.

FIG. 6 shows another form of web guide 7 for use in an apparatus of the invention. Swivel joints 42*a* and 42*b* are provided in the region of the entrance 7*a*, the effect being that the lateral walls 7*c*, 7*d* are pivotable in the direction of the arrows L, M and N, O.

Figure 7A:
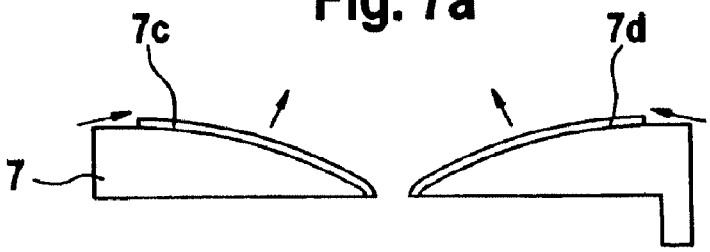
FIG. 7*a* is a schematic view of the interior of a third form of web guide with lateral walls of variable contour.
Figure 7B:
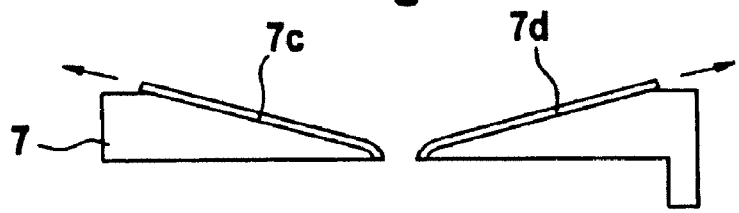
FIG. 7*b* shows the web guide of FIG. 7*a* with the lateral walls formed into a second contour.
Figure 7C:
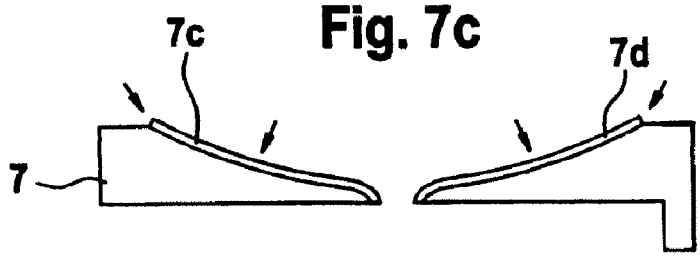
FIG. 7*c* shows the web guide of FIG. 7*a* with the lateral walls formed into a third contour.
Figure 7D:
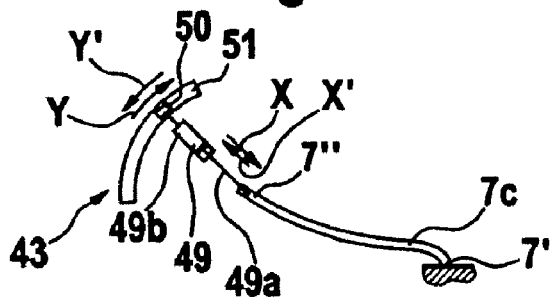
FIG. 7*d* shows schematically a mechanism for enabling the contour of the lateral walls to be altered, FIG. 8 us a schematic view of the interior of a fourth form of web guide with displaceable contour elements.

In the web guide of FIGS. 7*a* to 7*c*, the contour of the lateral walls 7*c*, 7*d* and consequently the deflection or guide surfaces for the fibre web 14 is variable from convex (FIG. 7*a*) through planar (FIG. 7*b*) to concave (FIG. 7*c*). The lateral walls 7*c*. 7*d* can be of resilient construction, as shown in FIG. 7*d*, for example, in the form of leaf springs or similar. In order to change the contour of the leaf spring 7*c* and hence the deflection or guide surface, the leaf spring can be fixedly mounted at one end 7', whereas an adjustment device 43 acts in the region of its other end 7". The adjustment device 43 can be adjusted manually, for example, by an adjusting screw or the like, or by motor, or can be in the form of a pneumatic cylinder 49. The push rod 49*a* of the pneumatic cylinder 49 is displaceable in the direction of the arrows X, X' and with one end is in rotatable engagement with the end region 7" of the leaf spring. The cylinder body 49*b* is mounted so as to be displaceable by way of a guide element 50, for example, a sliding block, in a curved guide 51 in the direction of the arrows Y, Y'. Depending on the position of the pressure cylinder 49, that is, on the one or the other side of the neutral axis of the leaf spring 7*c*, then with respect to the fibre sliver 14 the leaf spring 7*c*, and hence its deflecting and guide surface, is curved concavely in the direction of arrow Z (FIGS. 7*c*, 7*d*) or convexly in the direction of arrow Z' (FIG. 7*a*). The adjustment device 43 can be in the form of an actuator 30 connected to the control and regulating device 38 (see FIG. 4).

Figure 8:
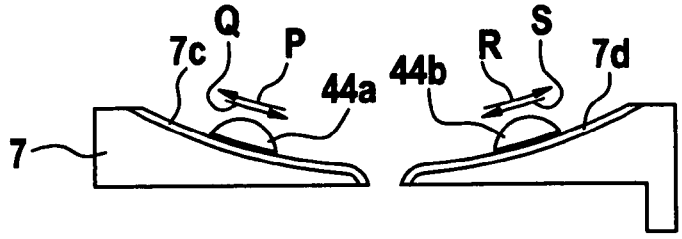

In a further web guide shown in FIG. 8, on the surface of the lateral walls 7*c* and 7*d* respective contour elements 44*a* and 44*b* are arranged, which are displaceable in direction P,Q and R,S respectively.

Figure 9:
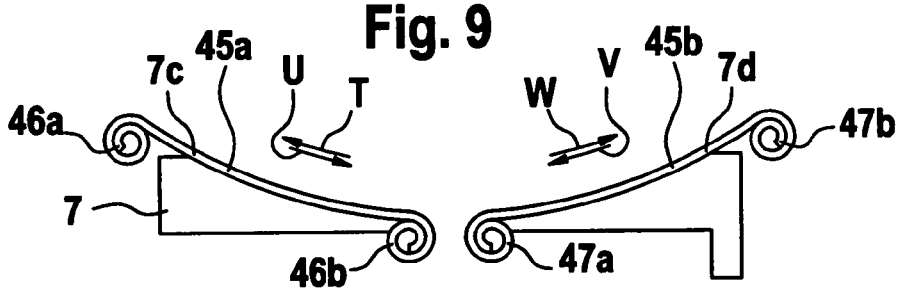
FIG. 9 is a schematic view of the interior of a fifth form of web guide.

In a web guide of FIG. 9, a foil or similar 45*a*, 45*b* is associated with a respective one of the surfaces of the lateral walls 7*c* and 7*d*, which is displaceable in the direction of the arrows T,U and V, W respectively around winding up and unwinding rolls 46*a*, 46*b*, 47*a*, 47*b*. The foil 45*a*, 45*b* has different coefficients of friction, roughness or frictional resistance or the like in the direction of the arrows T, U, V, W with respect to the fibre web 14. The foils 45*a*, 45*b* can alternatively be in the form (not illustrated) of endless belts around associated, driven belt guide rollers.

Figure 10:
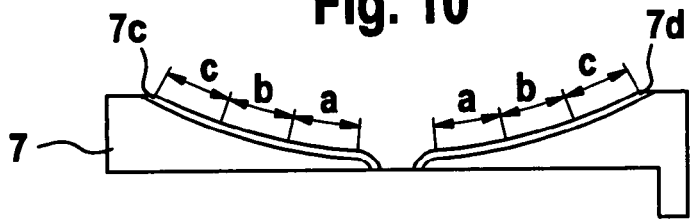
FIG. 10 is a schematic view of the interior of a sixth form of web guide.

In the web guide of FIG. 10, the surfaces of the lateral walls 7*c* and 7*d* are each in the form of three zones or regions a, b and c, which are different in respect of surface structure and/or surface frictional resistance. The zones or regions can be in the form of exchangeable or displaceable regions.

Figure 11:
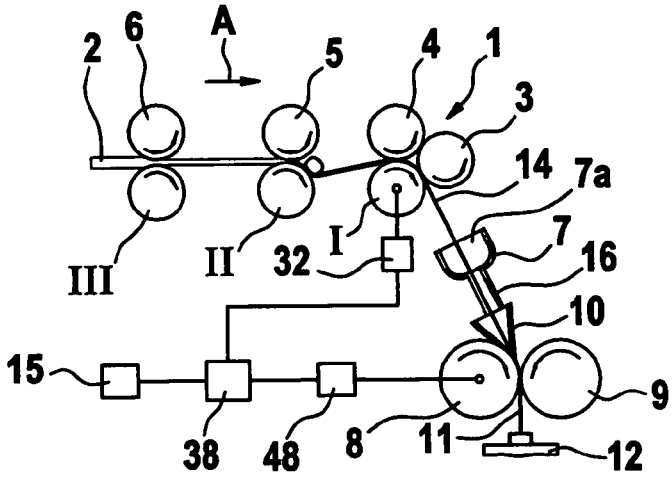
FIG. 11 is a diagrammatic side view of a further drafting system according to the invention.

In the web guide of FIG. 11, separate drive motors 32 and 48 which, in connection with the electrical control and regulating device 38, are associated with the delivery rollers 3, 4/I of the drafting system 1 and the take-off rollers 8, 9 respectively. In this way, the tension draft of the fibre structure is adjustable between the outlet of the drafting system 1 and the take-off rollers 8, 9.

The interaction and/or the spatial co-ordination between the fibre structure 14 and inner wall (lateral walls 7*c*, 7*d* and/or top wall 7*e* and/or bottom wall 7*f*) of the web guide 7 can advantageously be altered in operation, for example automatically as per the arrangement shown in FIG. 4 using actuating element 30. They can also be altered manually during or outside of operation, for example, by adjusting elements (adjusting screws or the like).

The invention encompasses arrangements in which the manner in which the inner wall contacts the fibre material can be changed. Thus the invention includes arrangements in which the web guide can be so adjusted that the spatial relationship between, on the one hand, the fibre material coming into contact with the inner wall and, on the other hand, the inner wall is changed. For example, the contour or position of at least a part of the inner wall may be variable such that the relative orientation of the fibre material and the inner wall surface is variable. The invention also includes arrangements in which the web guide can be so adjusted that the manner in which the inner wall physically interacts with the fibre material may be changed independently of any change in relative orientation. For example, the surface characteristics of the inner wall, such as frictional characteristics may be modifiable. The invention further includes arrangements in which both the spatial relationship is adjustable, and the interaction between the inner wall and the fibre is adjustable especially by varying the surface characteristics of the inner wall.

Although the foregoing invention has been described in detail by way of illustration and example for purposes of understanding, it will be obvious that changes and modifications may be practised within the scope of the appended claims.

What is claimed is:

1. A web guiding assembly for use in a sliver-forming textile machine, comprising;

a web guide;

a sliver funnel;

a take-off mechanism for taking-off fibre from the sliver funnel;

a camera located proximate the web guide to obtain images of the fibre material passing through the web guide; and a control and regulation device in communication with the camera;

wherein the web guide includes an inner wall with which the fibre material is, in use, in contact, and the control and regulation device is adapted to adjust a parameter of the contact between the inner wall and the fibre material in response to the images of the fibre material passing through the web guide.

2. An assembly according to claim 1, wherein the control and regulation device is adapted to adjust the interaction between the fibre material and the inner wall.

3. An assembly according to claim 1, wherein the control and regulation device is adapted to adjust a spatial relationship between the fibre structure and the inner wall.

4. An apparatus according to claim 1, in which the parameter is adjustable during operation of the textile machine and/or when the textile machine is not in operation.

5. An apparatus according to claim 1, in which the parameter is automatically adjustable.

6. An apparatus according to claim 1, in which the control and regulation device is adapted to at least partially reduce the frictional resistance of the inner wall by altering the interaction and/or the spatial co-ordination between fibre structure and inner wall of the web guide.

7. An apparatus according to claim 6, in which the control and regulation device is adapted to reduce the frictional resistance of the inner wall locally at one or more regions of the inner wall.

8. An apparatus according to claim 6, in which the control and regulation device is adapted to alter the coefficient of friction between the fibre structure and the inner wall.

9. An apparatus according to claim 1, in which the control and regulation device is adapted to alter the angle of inclination of the inner wall.

10. An apparatus according to claim 1, in which the inner wall is curved and the control and regulation device is adapted to alter a radius of curvature of the inner wall.

11. An apparatus according to claim 1, in which the inner wall is formed at least partially from a low-friction material.

12. An apparatus according to claim 1, in which the control and regulation device is adapted to alter the size and/or the position of the inlet opening of the web guide.

13. An apparatus according to claim 1, in which the control and regulation device is adapted to permit local reduction of frictional resistance between the inner wall and fibre structure at one or more points at which in use the fibre structure is subjected to greater forces.

14. An apparatus according to claim 1, in which the inner wall has a covering which has varying surface characteristics in the conveying direction.

15. An apparatus according to claim 14, in which the control and regulation device is adapted to displace the covering for presenting to the fibre material, in use, regions of the covering having different selected surface characteristics.

16. An apparatus according to claim 14, in which the varying surface characteristics give rise to a varying coefficient of friction.

17. An apparatus according to claim 1, in which the web guide has an inner wall surface that is so configured that all fibres of the fibre web travelling along that surface have to cover an approximately equal path until they are combined to form the fibre sliver.

18. An apparatus according to claim 1, in which the control and regulation device is adapted to alter the angle of orientation of lateral surfaces of the web guide.

19. An apparatus according to claim 1, in which at least a part of the inner wall surfaces of the web guide are of resilient construction.

20. An apparatus according to claim 1, in which the control and regulation device is adapted to alter the contour of lateral surfaces of the web guide.

21. An apparatus according to claim 20, in which the control and regulation device is adapted to alter at least a part of the inner wall surface between concave, planar and convex.

22. An apparatus according to claim 1, in which mobile contour elements are associated with the inner wall surface.

23. An apparatus according to claim 1, in which the control and regulation device is adapted to alter the resistance to wear of the inner wall.

24. An apparatus according to claim 1, in which the control and regulation device is adapted to alter the tension draft of the fibre structure passing through the web guide in dependence upon a signal relating to the fibre structure in the web guide.

25. An apparatus according to claim 1, including an upper web guide hinged cover as an inner wall.

26. An apparatus according to claim 1, including a lower web guide hinged cover as an inner wall.

27. An apparatus according to claim 1, in which the inner wall includes at least one lateral inner wall surface.

28. A drawing mechanism comprising at least one drafting zone, a drafting zone outlet and, downstream of the drafting zone outlet, an apparatus according to claim 1.

29. A draw frame comprising a drawing mechanism according to claim 28.

* * * * *